US006325375B1

(12) United States Patent
Potter et al.

(10) Patent No.: US 6,325,375 B1
(45) **Date of Patent: *Dec. 4, 2001**

(54) METHODS OF PROGRESSIVE JACKPOT GAMING SYSTEMS

(76) Inventors: Bruce H. Potter; Deborah J. Potter, both of P.O. Box 305, Surfside, CA (US) 90743

( * ) Notice: Subject to any disclaimer, the term of this patent is extended or adjusted under 35 U.S.C. 154(b) by 0 days.

This patent is subject to a terminal disclaimer.

(21) Appl. No.: 09/326,865

(22) Filed: Jun. 7, 1999

Related U.S. Application Data

(63) Continuation-in-part of application No. 08/903,234, filed on Jul. 18, 1997, now Pat. No. 5,951,011.

(51) Int. Cl.[7] ..... A63F 1/00

(52) U.S. Cl. ..... 273/292; 463/13; 463/26; 463/27

(58) Field of Search ..... 273/292, 309, 273/274; 463/13, 12, 26, 27

(56) References Cited

U.S. PATENT DOCUMENTS 4,861,041 * 8/1989 Jones et al. ..... 273/292

5,951,011 * 9/1999 Potter et al. ..... 273/292

OTHER PUBLICATIONS

Scarne's Encyclopedia Of Games by John Scarne, "Stud Poker", Harper & Row Publishers, pp33–38, Dec. 1973.*

* cited by examiner

*Primary Examiner*—Benjamin H. Layno

(57) ABSTRACT

Methods of Progressive Jackpot gaming are disclosed, wherein players are offered multiple chances to enter into a Progressive Jackpot wagering game each hand. Players are offered an initial Progressive Jackpot wagering opportunity prior to any cards being dealt, and are then offered subsequent wagering opportunities as they receive portions of their hand. A portion of each Progressive Jackpot wager is set aside for the Progressive Bonus. The amount of the Progressive Bonus, plus the amount of the Progressive Jackpot will be awarded to a player with the highest Progressive Jackpot hand rank (i.e. a Royal Flush) if that player placed a Progressive Jackpot wager at every offered opportunity.

26 Claims, 3 Drawing Sheets

METHODS OF PROGRESSIVE JACKPOT GAMING SYSTEMS

This is a continuation-in-part application of Ser. No. 08/903,234 filed Jul. 18, 1997 is now U.S. Pat. No. 5,951, 011.

BACKGROUND

1. Field of Invention

The present invention pertains to the field of Progressive Jackpot gaming. More specifically, this relates to a method of combining or including a Progressive Jackpot system in addition to casino card games that are played in casinos and cardrooms throughout the world.

2. Description of Prior Art

Many casinos and cardrooms throughout the world have been combining or including Progressive Jackpot wagering systems with a variety of table games Progressive Jackpot wagering systems are characterized by offering the player a one-time wager, which may be placed prior to the deal of the table game, which offer large payouts if an extremely hard to reach combination of cards is achieved by the player, i.e. a Royal Flush in poker. Progressive Jackpot wagering systems pay a predetermined percentage of the total of all Progressive Jackpot wagers, i.e. 100% for a Royal Flush, 10% for a Straight Flush, etc. and all amounts not paid each hand remain in the jackpot and carry over to the next hand. These Progressive Jackpot wagering systems add a high degree of excitement to the table games, provide a potential of high returns for players, and are major profit centers for casinos. Currently, however, players have only one opportunity to participate in the Progressive Jackpot wagering system during each hand; that one opportunity of before any cards have been dealt. These Progressive Jackpot systems cause a degree of frustration, because the players must place the Progressive Jackpot wager only prior to receiving any portion of their hand, in order to participate in any part of the Progressive Jackpot wagering system. Most of the time, the players will find that their hand is no where near achieving the requirement for a Progressive Jackpot payout. A large number of wagering game players do not participate in the current Progressive Jackpot systems, because they known the odds of achieving a qualifying hand are heavily against them, before seeing any cards.

Progressive Jackpot wagering systems that are combined with wagering table games are known. U.S. Pat. No. 4,861, 041 (to Jones et al.) discloses a method to combine a Progressive Jackpot wagering system with many table games U.S. Pat. No. 5,417,430 (to Breeding) discloses a method to combine a Progressive Jackpot wagering system with a modified version of 5-card stud poker. The aforementioned patents, however, only allow a player one option of entering into the Progressive Jackpot system; that single option is offered prior to the player viewing any portion of their hand. All current Progressive Jackpot systems are designed with a one time Progressive Jackpot wager which is placed prior to viewing any cards, wherein the casino will take a portion of the Progressive Jackpot wager for administrative costs. The full potential of added excitement and player satisfaction that can be provided by Progressive Jackpot systems has not yet been realized by these current Progressive Jackpot systems.

All players would welcome the option of entering into a Progressive Jackpot wagering system after viewing a portion of their hand. Many players would find a Progressive Jackpot wagering system even more exciting if it allowed multiple Progressive Jackpot wagers during each hand, with even larger possible payouts. Players who currently do not participate in Progressive Jackpot wagering systems would participate if given the opportunity to view a portion of their hand prior to placing a Progressive Jackpot wager, and other would participate more than once every hand. Casinos would receive greater profit from a Progressive Jackpot wagering system that allowed players multiple opportunities to participate each hand.

OBJECTS AND ADVANTAGES

It is an object of the present invention to provide an enhanced Progressive Jackpot wagering system that can be combined with a large variety of table games designed for use in casinos and cardrooms.

It is a feature of the present invention where a participant in a Progressive Jackpot wagering system is offered more than one opportunity to enter into the Progressive Jackpot wagering system, with one opportunity being offered prior to any cards being dealt and subsequent opportunities being offered as the players view their cards. This is an advantage over the prior art in the field since this will add an enhanced level of excitement, increase potential winnings, and increase income potential for the casino.

It is an advantage of the present invention that players can now view a portion of their hand prior to placing a Progressive Jackpot wager. This gives the player the opportunity to wait for a hand that has the potential to reach a Progressive Jackpot hand rank, before placing a jackpot wager, thereby reducing the risk and increasing the value to the player.

Still further objects and advantages will become apparent from a consideration of the ensuing detailed description.

REFERENCE NUMERALS

Figure 1:
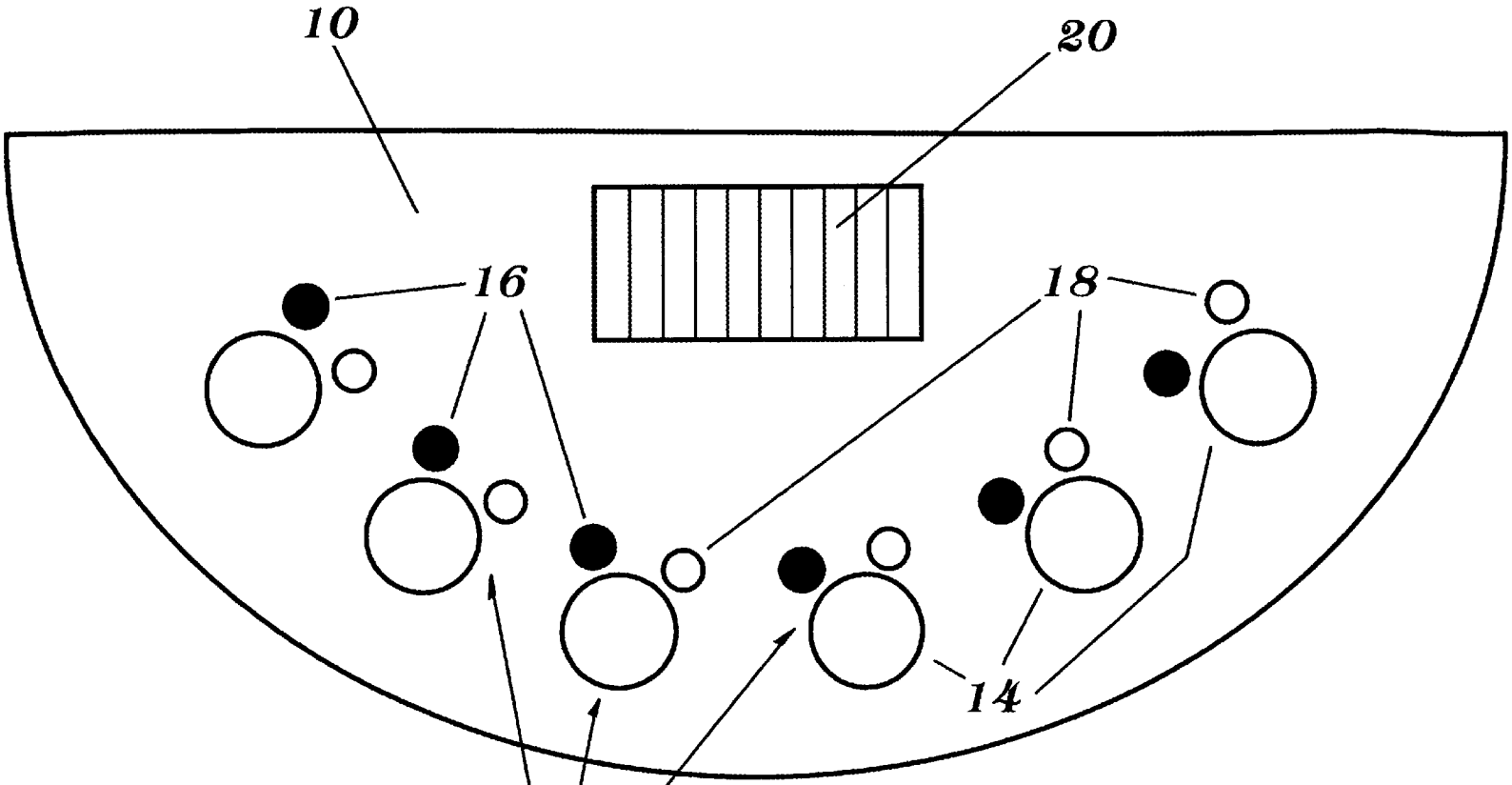
FIG. 1 shows the top view of a standard gaming table surface with Progressive Jackpot meter readout, and Progressive Jackpot wager sensors at each player location that would be useful for the preferred embodiment of the present invention.

10 playing surface
12 initial wager sensor
13 subsequent wager sensor
14 dual jackpot meter readout
15 wagering circle
16 chip rack
17 bank High hand box
18 bank Low hand box
20 player station
30 Progressive jackpot readout
32 Super Progressive Jackpot readout
40 through 60 flow chart items

SUMMARY

The present invention is a Progressive Jackpot wagering system that can be combined with many regular table games including Blackjack, Baccarat, Brag, Caribbean Stud®, Casino War™, Chemin De Fer, Let It Ride®, Faro, Five-card draw poker, Five-card stud poker, Hi/Low split poker, Lowball poker, Monte, Pai Gow poker, Pai Gow tiles, Panguine, Red Dog, Seven-card stud poker, Seven-and-a-Half, Super Pan-Nine, Three Card Poker™, Western Stud®, and other games of chance. Like other Progressive Jackpot wagering systems, the present invention offers each player the option of entering into the Progressive Jackpot system, by wagering a gaming token (typically one dollar ($1,)) prior to any cards being dealt. Each token that is wagered is added to the Progressive Jackpot, with the house deducting a predetermined amount for administrative costs. But, unlike all other Progressive Jackpot wagering systems, the present invention provides the players with one or more opportunities to enter the Progressive Jackpot wagering system, after viewing portions of their hand. Each player is offered a number of subsequent wagering opportunities regardless of whether or not they entered into the Progressive Jackpot wagering system before viewing a portion of their hand. Each subsequently wagered token will be added to the Progressive Jackpot in the same manner as the initial Progressive Jackpot wager. Other embodiments require that players must place the initial Progressive Jackpot wager in order to place subsequent Progressive Jackpot wagers. Further embodiments require that the initial Progressive Jackpot wager be placed for the player to participate in the table game.

The present invention will offer a number of subsequent wagering opportunities with a cumulative payout potential, giving players the opportunity to win more than 100% of the amount allocated to the Progressive Jackpot. The player would have an opportunity to win a Super Progressive Jackpot that is larger than the Progressive Jackpot. Each Progressive Jackpot wager will be allocated with a portion set aside for a Progressive Bonus, the Super Progressive Jackpot will consist of the Progressive Jackpot money plus the amount of money set aside for the Progressive Bonus. The preferred apparatus of the present invention will be comprised of the standard gaming tables used with Progressive Jackpot wagering games, wherein coin acceptors are built into the gaming table and electrically connected to a Progressive Jackpot meter. The meter's readout will differ from typical Progressive Jackpot wagering games as it will have two readouts, one will display the amount of the Progressive Jackpot, and the other will display the Super Progressive Jackpot, the Progressive Jackpot plus the Progressive Bonus.

DETAILED DESCRIPTION

Figure 2:
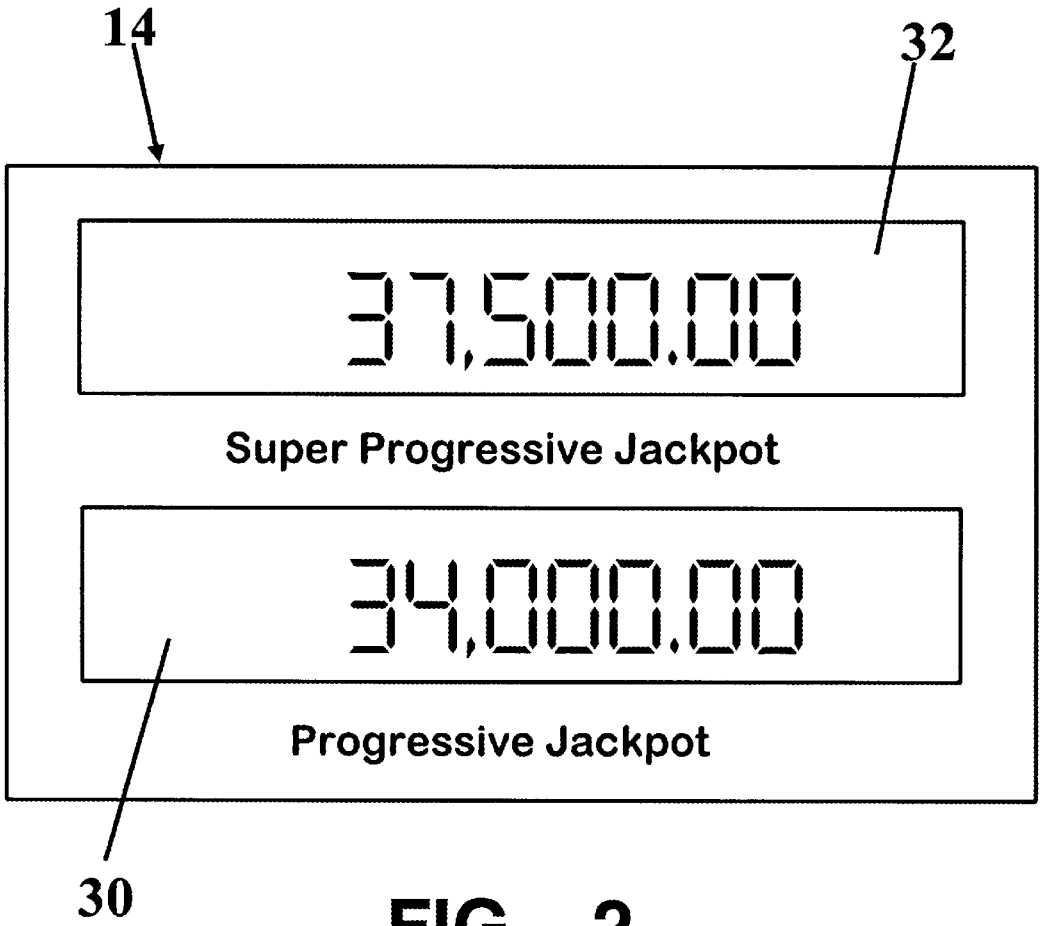
FIG. 2 shows the face of a jackpot meter readout device that would be useful for the present invention.

In the preferred embodiment of the present invention, The progressive Jackpot wagering system is combined with Western Stud®, a modified version of High/Low poker, that is protected by and described with U.S. Pat. No. 5,494,295 to (Potter et al., applicant). As shown in FIG. 1, a gaming table 10 is provided with a initial wager sensor 12, and a subsequent wager sensor 13, directly above a player station 20 of which there are seven, each of which include a wagering circle 15. Each initial wager sensor 12, and subsequent wager sensor 13, will be connected to a jackpot meter (not shown) that will have a dual jackpot meter readout 14, which is shown in greater detail in FIG. 2 and is more fully explained herein. A dealer will be positioned behind a chip rack 16. The wagering game of the preferred embodiment utilizes two dealer hands, a standard poker hand and a lowball poker hand. The dealer will place each one of these hands in a bank High hand box 17, and a bank Low hand box 18 respectively. As shown in FIG. 2, dual jackpot meter readout 14 includes two readouts, possibly LCD, a Progressive Jackpot readout 30, and a Super Progressive Jackpot readout 32.

Figure 3:
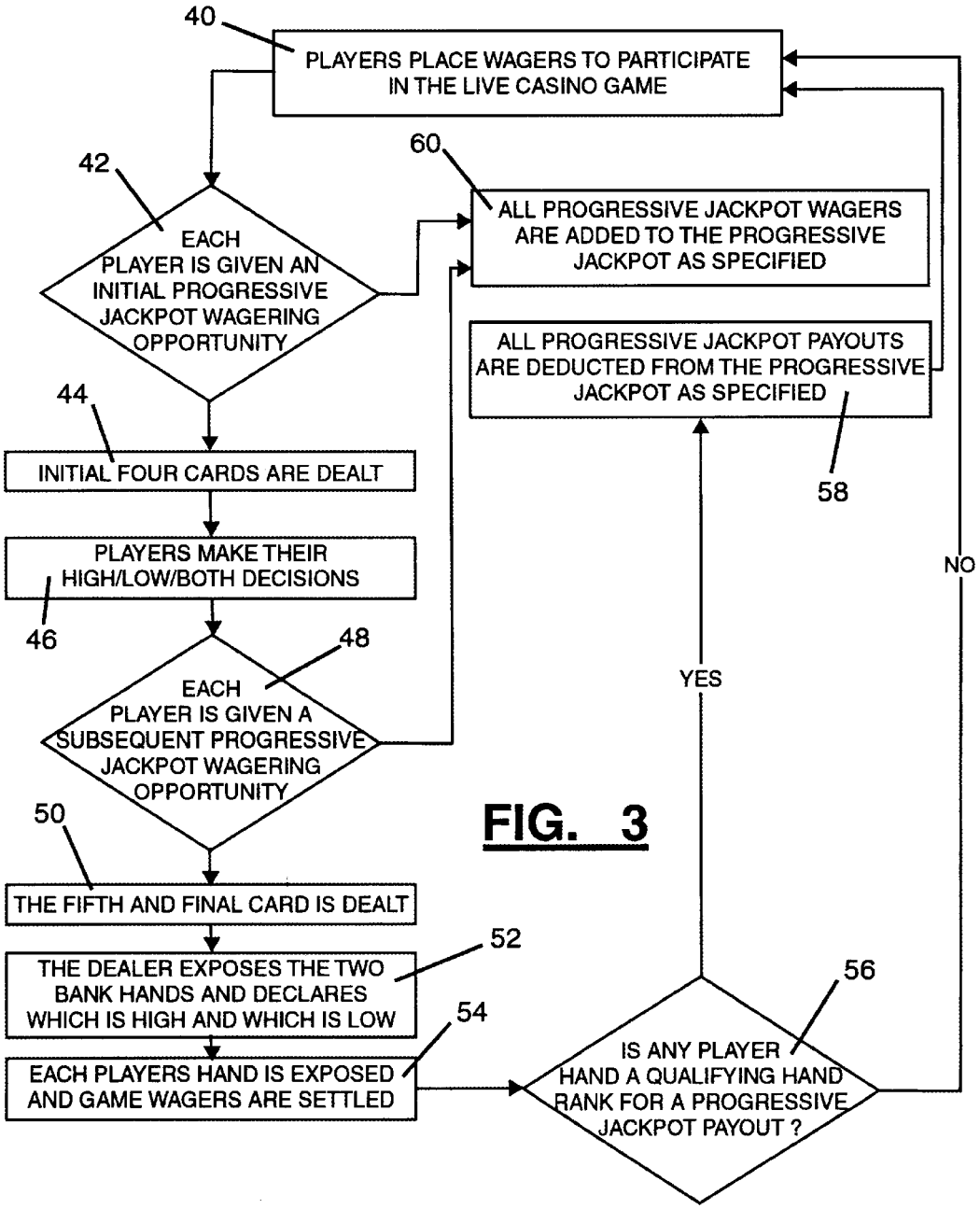
FIG. 3 is a flow chart showing the operation of the preferred embodiment of the present invention.

The preferred embodiment of the present invention operation as shown in FIG. 3 as follows. Each player places a wager in wagering circle 15 to participate in the wagering table game, block 40. Each player is given an option to place an initial Progressive Jackpot wager, decision block 42. Each player who decides to place the initial Progressive Jackpot wager will place a token on initial wager sensor 12 prior to any cards being dealt. All Progressive Jackpot wagers will be allocated to the Progressive Jackpot, and the Progressive Bonus as specified herein, block 60. Each player is now dealt their first four cards, block 44. Each player now must decide which of the bank hands to play their hand against, (the High hand (standard poker,) the Low hand (lowball poker,) or both hands,) and place their four cards face down in the corresponding box within player station 20, block 46. Each player is now offered a subsequent Progressive Jackpot wagering opportunity, decision block 48. Each player that decides to place the subsequent Progressive Jackpot wager will place a token on subsequent wager sensor 13. When the subsequent Progressive Jackpot wagers are placed, they are added to the Progressive Jackpot, and the Progressive Bonus as specified herein, block 60. The last card is now dealt to each player, therefore complexing their hand, block 50. The dealer now exposes both of the bank hands, and according to a predetermined set of guidelines, declares which hand will play High, (standard poker,) and which hand will play Low (lowball poker.) The High hand is then placed in bank High hand box 17, and the Low hand is placed in bank Low hand box 18 block 52. Each player's complete five card hand is now exposed, compared to the specific bank hand the player chose to play against, (High, Low, or both,) and the table game wagers are settled, block 54. Next, the players hand are exposed, and each player that placed the initial Progressive Jackpot wager or the subsequent Progressive Jackpot wager will have their hand compared to the list of qualifying Progressive Jackpot hand ranks, explained herein, decision block 56. If no qualifying Progressive Jackpot hand ranks exist, the next hand begins, block 40. If any hand qualifies for a Progressive Jackpot payout, the monetary amount of the Progressive Jackpot payout is determined, ax explained herein, and the player with the qualifying hand is paid the determined amount. The determined monetary amount paid to the player is then deducted from the Progressive Jackpot, and Progressive Bonus as specified herein, block 58.

A predetermined list of hand ranks that qualify for a Progressive Jackpot payout percentage must be provided. The Progressive Jackpot hand ranks and payouts for the embodiment described above could be structure as follows:

TABLE A (Qualifying Hand Rank Payouts)

| Progressive Jackpot Hand Rank | Percentage of Progressive Jackpot |
|---|---|
| Royal Flush | 100% |
| Straight Flush | 10% |
| 4 of a Kind | 5% |
| Full House | 1% |
| Flush | .5% |

Since the table game of the preferred embodiment utilizes two sets of rules, standard poker and lowball poker, payouts could be provided for hands that qualify in both sets. For example "5" high straight, (Ace,2,3,4,5,) is the best hand that can be achieved in lowball poker, therefore payouts could be provided for a "5" high straight flush and a "5" high straight. The table game of the preferred embodiment will utilize one standard deck of 52 cards. If the "house" desires a Joker, or more than one Joker, may be added to the deck. Adding a Joker or Jokers could change the above payout chart.

Prior to the hands being dealt, and prior to the last card being dealt, each player will be given a sufficient amount of time to place a Progressive Jackpot wager. Each token that is wagered on initial wager sensor 12, and subsequent wager sensor 13, will result in the amount of the Progressive Jackpot, and the amounts shown on dual jackpot meter readout 14 to be increased by a predetermined amount for each token. A player with a qualifying hand rank that placed only the initial Progressive Jackpot wager is entitled to win 100% of the corresponding payout listed in Table A. Since players are given an opportunity to view a portion of their hand prior to placing the subsequent Progressive Jackpot wager, a player with a qualifying hand rank that placed only the subsequent wager with be entitled to a smaller percentage of the corresponding payout listed in Table A. Therefore the following payout percentages have been provided.

TABLE B (Percentage of Qualifying Hand Rank Payout)

| Progressive Jackpot wager | Percentage of Table A Payout |
|---|---|
| Initial Progressive Jackpot wager | 100% |
| subsequent Progressive Jackpot wager | 10% |

Any player, however, that places the initial Progressive Jackpot wager and the subsequent Progressive Jackpot wager should be entitled to more than 100% of the payouts listed in Table A. The above percentages, therefore, are a cumulative payout for all qualifying Progressive Jackpot hand ranks. A player that places the initial Progressive Jackpot wager and the subsequent Progressive Jackpot wager, whose hand achieves a qualifying Jackpot hand rank, would therefore be entitled to 110% of the payout listed in Table A. The 110% is the total of the percentages from Table B (100% for initial Progressive Jackpot wager, and 10% for the subsequent Progressive Jackpot wager.) Thus, a player with a Royal Flush that placed the initial Progressive Jackpot wager and the subsequent Progressive Jackpot wager, would be entitled to a minimum payout of 110% of the Progressive Jackpot amount shown on Progressive Jackpot readout 30. A player that places both the initial Progressive Jackpot wager and the subsequent Progressive Jackpot wager whose hand achieves a Royal Flush would be entitled to the full amount shown on Super Progressive Jackpot readout 32, which will always show an amount equal to or greater than 110% of the amount shown on Progressive Jackpot readout 30, as further explained herein.

Therefore, the amount of the Progressive Jackpot that a player with a qualifying jackpot hand rank would be entitled to would be based on the rank of their hand and how many Progressive Jackpot wagers that the player placed. The following table (Table C) illustrates the percentage of the Progressive Jackpot that is player with a qualifying hand would be entitled, based upon the numbers from Table A and Table B.

TABLE C (Progressive Jackpot Payouts (%))

| Number of Jackpot Wagers ↓ | Qualifying Hand RanK → Royal Flush | Straight Flush | 4 of a Kind | Full House | Flush |
|---|---|---|---|---|---|
| Initial only | 100 | 10 | 5 | 1 | .5 |
| Subsequent only | 10 | 1 | .5 | .1 | .05 |
| Both Initial & Subsequent | 100* | 11 | 5.5 | 1.1 | .55 |

*This payout is a percentage of the Super Progressive Jackpot amount.

If a player places the initial Progressive Jackpot wager and the subsequent Progressive jackpot wager, and their hand achieves a Straight Flush, the player will be paid 11% of the amount displayed on Progressive Jackpot readout 30, which is equal to 110% of the 10% payout for a Straight Flush, (from Table A.) A player who wagers only the subsequent Progressive Jackpot wager, whose hand achieves a Royal Flush is entitled to 10% of the amount displayed on Progressive Jackpot readout 30. A player who wagers the initial Progressive Jackpot wager only, whose hand achieves a Royal Flush would be entitled to 100% of the amount displayed on Progressive Jackpot readout 30.

The present invention provides for what appear to be exceedingly, high payouts. The wagered tokens, however, are not allocated in the same manner as the current Progressive Jackpot systems. The gate will utilize Progressive Jackpot meter (not shown) that will track and allocate every token that is wagered in the Progressive Jackpot game. Each token could be allocated into three separate accounts as follows:

TABLE D (Token Allocation)

| Percentage of Each Token Wagered | Allocation of Funds |
|---|---|
| 68% | Progressive Jackpot account |
| 7% | Progressive Bonus account |
| 25% | casino administrative costs |

Progressive Jackpot meter (not shown) utilizes dual jackpot meter readout 14 shown in FIG. 2. Progressive Jackpot readout 30 will display the amount allocated to the Progressive Jackpot account Super Progressive Jackpot readout 32 will display the amount allocated to the Progressive Jackpot account plus the amount of the Progressive Bonus account. Each gaming token that is wagered and placed on either initial wager sensor 12, or subsequent wager sensor 13, is added to both the Progressive Jackpot and Progressive Bonus accounts, where 68% is allocated to the Progressive Jackpot account, and 7% is allocated to the Progressive Bonus account. Progressive Jackpot meter (not shown) will increment Progressive Jackpot readout 30 by 68% of the value of each gaming token wagered, and increment Super Progressive Jackpot readout 32 by 75% (68%+7%), as outlined above, of the value of each gaming token wagered. A player whose hand rank achieves the rank of Royal Flush is entitled to at least 110% of the Progressive Jackpot account. The 75% incrementation is greater than 110% of the 68% allocated to the Progressive Jackpot account. This percentage represents the amount a player would win if their hand is the rank of Royal Flush, and they placed the initial Progressive jackpot wager prior to any cards being dealt, and the subsequent Progressive Jackpot wager, after viewing the first four cards. Super Progressive Jackpot readout 32 will always display the sum of the amount shown on Progressive Jackpot readout 30, (the Progressive Jackpot account,) plus the amount of the Progressive Bonus account. All Progressive Jackpot payouts from Table C are a percentage of the Progressive Jackpot account, (the amount displayed on Progressive Jackpot readout 30,) unless the player placed both the initial Progressive Jackpot wager and the subsequent Progressive Jackpot wager, and the players hand rank is a Royal Flush, which entitles the player to receive the entire amount in the Progressive Jackpot account, and the entire amount in the Progressive Bonus account, (the amount on Super Progressive Jackpot readout 32.)

Following is an example of how the Progressive Bonus operates: If $50,000.00 worth of tokens is wagered into the Progressive Jackpot wagering system and no Progressive Jackpot payouts have been paid. Progressive Jackpot readout 30 will read $34,000.00, (68% of $50,000.00.) Super Progressive Jackpot readout 32 will read the sum of the Progressive Jackpot account plus the Progressive Bonus account, a total of $37,500.00, (75% of $50,000.00.) The $37,500.00 breaks down as follows: $34,000.00 (68% of $50,000.00) is the amount of the Progressive Jackpot account and $3,500.00 (7% of $50,000.00) is the amount of the Progressive Bonus account. If a player wagers both the initial Progressive Jackpot wager and the subsequent Progressive Jackpot wager, and their hand achieves a Straight Flush (which is not the Super Progressive Jackpot hand,) that layer will be paid $3,740.00 (11% (from Table C above) of the amount on Progressive Jackpot readout 30.) Progressive Jackpot readout 30 will then be decremented to read $30,260.00 ($34,000.00 (the original amount of the Progressive Jackpot account) minus $3,740.00 (the amount the player was paid.)) Super Progressive Jackpot readout 32 will be simultaneously decremented to read $33,760.00, ($30,260.00 (the remaining amount the Progressive Jackpot account)+$3,500.00 (the amount of the Progressive Bonus account.)) This $33,760.00 will then be carried over to the next hand of the casino wagering game.

Typically Progressive Jackpot systems require an initial amount of money called "seed" money to get the Progressive Jackpot started; this amount may vary. The Progressive Jackpot system of the embodiment described above will require that the Progressive Bonus be "seeded" when the Progressive Jackpot is "seeded." The Progressive Bonus must be "seeded" with at least 10% of the amount that the Progressive Jackpot is "seeded" with. The Progressive Jackpot system of the present invention could be "seeded" in many ways. For example, if the casino wishes to "seed" the Progressive Jackpot with $22,000, the Progressive Jackpot account could get $20,000 and the Progressive Bonus account could get $2,000 this would ensure that a player with a Royal Flush would get at least 110% of the amount on Progressive Jackpot meter readout 30. When the accounts are "seeded" the sum of the Progressive Jackpot account and the Progressive Bonus account must be equal to or greater then 110% of the amount of the Progressive Jackpot account. The house may want to "supper seed" the Progressive Bonus account thus giving the player a greater incentive to place the initial Progressive Jackpot wager. For example, if the house wants to "seed" to Progressive Jackpot system with $10,000 the Progressive Jackpot account could get $9,000, and the Progressive Bonus account could get $1,000, thus a player with both the initial Progressive Jackpot wager and the subsequent Progressive Jackpot wager, whose hand achieves the rank of Royal Flush would receive a payout of more than 110% of the amount on Progressive Jackpot meter readout 30. Typically a greater percentage of each Progressive Jackpot wager will be allocated to casino administrative costs until the "seed" money has been reimbursed to the casino.

There are many variations of the above described embodiment that could be implemented. For example, the payouts from Table A above could be changed and different qualifying hand ranks could be used. The allocations from Table D above could be different with an even greater amount allocated to the Progressive Bonus account. The Progressive Jackpot system could be modified where the player would be required to place the initial Progressive Jackpot wager, prior to the cards being dealt, to participate in the wagering table game. The Progressive Jackpot system could also be modified to require that the player would not have the opportunity to place the subsequent Progressive Jackpot wager unless the player placed the initial Progressive Jackpot wager, prior to the cards being dealt.

Alternate embodiments of the present invention utilize only one Progressive Jackpot account wherein all Progressive Jackpot wager minus the casino administration cost are added to, and from which all Progressive Jackpot payouts are paid. Thereby, eliminating the need for the Progressive Bonus account. The payout percentages of the Progressive Jackpot wagers will differ from the above described preferred embodiment. Predetermined payout percentages for each Progressive Jackpot wager will have to be provided. For example, in the game of Western Stud®, described above, the qualifying hand ranks and payouts could be as follows:

TABLE 1A (Qualifying Hand Rank Payouts)

| | Initial Progressive Jackpot wager | Subsequent Progressive Jackpot wager | Both Progressive Jackpot wagers |
|---|---|---|---|
| Royal Flush | 90% | 10% | 100% |
| Straight Flush | 9% | 1% | 10% |
| 4 of a Kind | 4.5% | .5% | 5% |
| Full House | .9% | .1% | 1% |
| Flush | .45% | .05% | .5% |

Each Progressive Jackpot wager is allocated with the "house" taking a predetermined percentage for administrative costs, and adding the remaining amount to the Progressive Jackpot account. Super Progressive Jackpot meter readout 32 would be removed from dual jackpot meter readout 14, therefore the entire amount in the Progressive Jackpot account would be displayed on Progressive Jackpot meter readout 30. The amount displayed on Progressive Jackpot meter readout 30 is the amount a player would be paid if the player placed both Progressive Jackpot wagers, (initial and subsequent,) and their hand achieved the rank of Royal Flash. A player that placed only the subsequent Progressive Jackpot wager whose hand achieves the rank of Straight Flash would win 1% (from Table 1A) of the amount of the Progressive Jackpot account, (the amount displayed on Progressive Jackpot meter readout 30.)

Following is an example of how the Progressive Jackpot system of the present invention works without the Progressive Bonus account: If $50,000.00 worth of tokens is wagered into the Progressive Jackpot wagering system and no Progressive Jackpot payouts have been pad, Progressive Jackpot readout 30 will read $37,500.00, (75% of $50,000.00) If a player wagers both the initial Progressive Jackpot wager and the subsequent Progressive Jackpot wager, and their hand achieves a Straight Flush, that player will be paid $3,750.00, 10% (from Table 1A) of the $37,500.00 in the Progressive Jackpot account, (the amount displayed on Progressive jackpot meter readout 30.) The amount displayed on Progressive Jackpot meter readout 30, will be decremented to read $33,750,00 ($37,500.00 (the amount of the Progressive Jackpot account) minus $3,750.00 (the amount paid to the player.)) The $33,750.00 is the new amount of the Progressive Jackpot account and is carried over to the next hand of the wagering table game.

Additional subsequent Progressive Jackpot wagers could be added to the above described embodiment. For example, the dealer could deal out the first three cards and give the players the option of placing a first subsequent Progressive Jackpot wager. The dealer would then deal a fourth card and give the players the option of placing a second subsequent Progressive Jackpot wager. The payouts from Table 1A would be different than outlined above for this embodiment.

Other variations of the present invention could be utilized. The amount allocated for the casino administrative costs could be different. The Progressive Jackpot system could be modified where the player would be required to place the initial Progressive Jackpot wager, prior to the cards being dealt, to participate in the wagering table game. The Progressive Jackpot system could also be modified to require that the player would not have the opportunity to place a subsequent Progressive Jackpot wager unless the player placed the initial Progressive Jackpot wager, prior to the cards being dealt.

Further embodiments of the present invention combine the above described Progressive Jackpot wagering system with poker type wagering games wherein players wager against each other and the "house" changes the players either by time, per hand, or a percentage of the "pot," the total amount wagered. Poker type games utilize wagering rounds immediately after the players receive a card or cards, dealt directly to their own hand, or dealt as a community card or cards wherein each player is given the option of placing a wager, within predetermined limits. Each other player must "call" the wager by wagering the same amount, "raise" the wager by wagering more than the same amount or "fold" their cards and forfeit all rights to the "pot."

One example, would be the same of 5-card stud poker. In this game each player is initially dealt two cards, one face down and one face up, followed by a wagering round. Next, each player that has not folded their cards receives three additional cards, dealt singly, face up, each card being followed by a wagering round. In this embodiment, each player will be given an opportunity to place an initial Progressive Jackpot wager, prior to any cards being dealt. The dealer will then deal the first two cards, followed by a wagering round, and each player that has not folded their cards, will be given an opportunity to place the first subsequent Progressive Jackpot wager. The dealer will then deal the third card, followed by a wagering round, and again each player that has not folded their cards will be given the option to place the second subsequent Progressive Jackpot wager. The dealer will then deal the fourth card, followed by a wagering round, and all players that have not folded their cards will be given the option of placing the third subsequent Progressive Jackpot wager. The dealer will then deal the last card followed by a wagering round, all players that have not folded their cards will now expose their face down card revealing the rank of their hand. The dealer will award the "pot" to the player with the highest ranking hand. Any player that has a hand with a rank of Flush or better will be entitled to a portion of the Progressive Jackpot if the player placed the initial and/or any subsequent Progressive Jackpot wagers. The amount of the Progressive Jackpot that the player is entitled is calculated, the player is paid that amount, and that amount is deducted from the Progressive Jackpot account and therefore decremented from Progressive Jackpot meter readout 30. If any player has a hand rank of a Royal Flush and the player placed the initial Progressive Jackpot wager and all subsequent Progressive Jackpot wagers, then the player will be entitled to the entire amount of the Progressive Jackpot account and the entire amount of the Progressive Jackpot Bonus account. The player would then be paid the amount on Super Progressive Jackpot meter readout 32 and the Progressive Jackpot account and the Progressive Bonus account would be "re-seeded."

The Progressive Jackpot system of the present invention is structured very differently in this embodiment from the described preferred embodiment, because there are four Progressive Jackpot wagering opportunities. The qualifying Progressive Jackpot hand ranks and payout percentages could be structured the same as in the above described embodiment:

TABLE AA

Poker-type game, (Qualifying Hand Rank Payouts)

| Jackpot Hand Rank | Percentage of Progressive Jackpot |
|---|---|
| Royal Flush | 100% |
| Straight Flush | 10% |
| 4 of a Kind | 5% |
| Full House | 1% |
| Flush | .5% |

Utilizing a total of four Progressive Jackpot wagering opportunities changes the payout percentages that a player would be entitled to, and would therefore be structured differently from the described preferred embodiment. The percentage of the Progressive Jackpot that a player would be entitled to could be structured as follows:

TABLE BB

Poker-type game, (Percentage of Qualifying Hand Rank Payout)

| Progressive Jackpot wager | Percentage of Table AA |
|---|---|
| prior to any cards dealt | 100% |
| 1st subsequent Progressive Jackpot wager | 40% |
| 2nd subsequent Progressive Jackpot wager | 10% |
| 3rd subsequent Progressive Jackpot wager | 5% |

The Progressive Jackpot payouts would therefore be:

TABLE CC

Poker-type game, (Jackpot Payouts (%))

| Number of Jackpot Wagers ↓ | Qualifying Hand Rank → Royal Flush | Straight Flush | 4 of a Kind | Full House | Flush |
|---|---|---|---|---|---|
| Initial only | 100 | 10 | 5 | 1 | .5 |
| Initial & 1st subsequent | 140 | 14 | 7 | 1.4 | .7 |
| Initial & 2nd subsequent | 110 | 11 | 5.5 | 1.1 | .55 |

TABLE CC-continued

| Number of Jackpot Wagers ↓ | Poker-type game, (Jackpot Payouts (%)) Qualifying Hand Rank → Royal Flush | Straight Flush | 4 of a Kind | Full House | Flush |
|---|---|---|---|---|---|
| Initial & 3rd subsequent | 105 | 10.5 | 5.25 | 1.05 | .525 |
| Initial 1st & 2nd subsequent | 150 | 15 | 7.5 | 1.5 | .75 |
| Initial, 1st, & 3rd subsequent | 145 | 14.5 | 7.25 | 1.45 | .725 |
| Initial, 2nd, & 3rd subsequent | 115 | 11.5 | 5.75 | 1.15 | .575 |
| Initial & 1st, 2nd & 3rd subsequent | 100* | 15.5 | 7.75 | 1.55 | .775 |
| 1st subsequent - no initial | 40 | 4 | 2 | .4 | .2 |
| 2nd subsequent - no initial | 10 | 1 | .5 | .1 | .05 |
| 3rd subsequent - no initial | 5 | .5 | .25 | .05 | .025 |
| 1st & 2nd subsequent - no initial | 50 | 5 | 2.5 | .5 | .25 |
| 1st & 3rd subsequent - no initial | 45 | 4.5 | 2.25 | 4.05 | .225 |
| 2nd & 3rd subsequent - no initial | 15 | 1.5 | .75 | .15 | .075 |
| 1st, 2nd & 3rd subsequent - no initial | 55 | 5.5 | 2.75 | .55 | .275 |

*This payout is a percentage of the Super Progressive Jackpot amount.

Since there are four Progressive Jackpot wagering opportunities, a greater amount or percentage of each token wagered must be allocated to the Progressive Bonus account. The allocation of each gaming token could be as follows:

TABLE DD

| Poker-type game, (Token Allocation) Percentage of Token | Allocation of Funds |
|---|---|
| 48% | Progressive Jackpot account |
| 27% | Progressive Bonus account |
| 25% | casino administrative costs |

The poker-type games could also utilize the Progressive Jackpot system of the present invention, without the Progressive Bonus account. If the Progressive Jackpot system is used without the Progressive Bonus, the payouts could be structured as follows:

TABLE 1AA

| Poker-Type game, (Qualifying Hand Rank Payouts) | Initial Progressive Jackpot wager | 1st Subsequent Progressive Jackpot wager | 2nd Subsequent Progressive Jackpot wager | 3rd Subsequent Progressive Jackpot wager |
|---|---|---|---|---|
| Royal Flush | 60% | 25% | 10% | 5% |
| Straight Flush | 6% | 2.5% | 1% | .5% |
| 4 of a Kind | 3% | 1.25% | .5% | .25% |
| Full House | .6% | .25% | .1% | .05% |
| Flush | .3% | .125% | .05% | .025% |

The above payouts would be cumulative, so that a player with all four Progressive Jackpot wagers placed, whose hand achieves the rank of Royal Flush would be entitled to 100% of the amount in the Progressive Jackpot account. If a player whose hand achieved the rank of Royal Flush placed only the three subsequent Progressive Jackpot wagers and not the initial Progressive Jackpot wager, then the player would be entitled to 40% of the amount of the Progressive Jackpot account.

The embodiments used with poker type games could utilize the many variations described in the preferred, and alternate embodiments described above. For example; the payouts from Table AA, and Table 1AA, above could be changed and different qualifying hand ranks could be used. The allocations from Table DD above could be different with an even greater amount allocated to the Progressive Bonus account, or a different amount for casino administrative costs. The Progressive Jackpot system could be modified where the player would be required to place the initial Progressive Jackpot wager, prior to the cards being dealt, to participate in the poker type wagering game. The Progressive Jackpot system could also be modified to require that the player would not have the opportunity to place any subsequent Progressive Jackpot wager unless the player placed the initial Progressive Jackpot wager, prior to the cards being dealt.

Other embodiments of the present invention will combine the Progressive Jackpot system to games where the player is not dealt a set amount of cards. One example is Blackjack, were the players are each dealt two cards and are given the option to receive more cards. These optional cards are called "hit" cards. Each player is given an option to place the initial Progressive Jackpot wager, prior to any cars being dealt, and subsequent Progressive Jackpot wagers with each "hit" card. The Super Progressive Jackpot wining hand in this game could be Ace,2,3,4,5,6. This would allow for an initial Progressive Jackpot wager as well as up to four subsequent Progressive Jackpot wagers. The Progressive Jackpot system of this embodiment would be structured very differently than in the above described embodiments, due to the fact that players may reach a Progressive Jackpot payout qualifying hand rank prior to all Progressive Jackpot wagering opportunities being offered. For example, there maybe a payout for 2,3,4,5,6 in which case a player with this hand would have to decide whether to take the payout for the hand, or risk taking another "hit" to try to get an Ace for the Super Progressive Jackpot winning hand.

A Progressive Jackpot system such that has been demonstrated in the above embodiments could be combined with many different table games. The specific Progressive Jackpot hand ranks, payout percentages, number of subsequent wagers, and the allocation of Progressive Jackpot wagers will vary from game to game. The Progressive Jackpot system illustrated could be interlinked with other wagering table games using the Progressive Jackpot system.

Conclusions, Ramifications, and Scope

Accordingly, it is apparent that the present invention provides a method whereby a casino or cardroom can offer their clientele a Progressive Jackpot system that is far more exciting and beneficial to the players than any of the Progressive Jackpot systems currently being offered.

Although the description above contains many specificities, these should not be construed as limiting the scope of the invention, but as merely providing illustrations of some of the presently preferred embodiments of the invention. For example, versions of the above described embodiments could be incorporated into single player or multi-player electronic gaming devices, internet gaming appilcations, and intranet (in room) type gaming applications wherein electronic hardware and software would replace the dealer.

Thus the scope of the invention should be determined by the appended claims and their legal equivalents, rather than by the examples given.

We claim:

1. A method of including or combining a progressive jackpot wagering system in addition to a casino card game using at least one deck of playing cards comprising the steps of:

a) a player placing a casino card game wager to participate only in said casino card game;

b) providing said player an option to place a progressive jackpot wager to participate only in said progressive jackpot wagering system prior to viewing any cards;

c) dealing a portion of a complete card hand to said player, wherein said complete card hand comprising a maximum number of cards said player receives before settling said casino card game wager and ending the casino card game, providing said player a further option to place said progressive jackpot wager to participate only in said progressive jackpot wagering system after viewing said portion of said complete card hand, wherein said progressive jackpot wager comprises a fixed monetary amount;

d) apportioning said fixed monetary amount of each said progressive jackpot wager, with unequal amounts apportioned into each one of a progressive jackpot and a progressive bonus through a predetermined allocation in said jackpot wagering system, and separately allocating said progressive jackpot and said progressive bonus apart from said casino card game wager;

e) dealing a remaining portion of said complete card hand, and ending said casino card game by settling said casino card game wager wherein said player either wins or loses said casino card game at the end of every casino card game; and f) if said player exercised said option and/or said further option and said complete card hand comprises a predetermined arrangement of cards, then said player wins a predetermined percentage of said progressive jackpot, and if said player exercised said option and said further option and said complete card hand comprises a predetermined arrangement of cards, then said player wins a predetermined percentage of said progressive jackpot and said progressive bonus, and deducting said predetermined percentage from said progressive jackpot and of said progressive bonus.

2. A method of including or combining a jackpot wagering system with a casino card game according to claim 1 wherein said player wins said predetermined percentage of said progressive bonus only if said player exercised said option and said further option.

3. A method of including or combining a jackpot wagering system with a casino card game according to claim 2 wherein said player must exercise said option.

4. A method of including or combining a jackpot wagering system with a casino card game according to claim 2 wherein said player is not offered said further option unless said player exercised said option.

5. A method of including or combining a jackpot wagering system with a casino card game according to claim 2 wherein said casino card game is Western Stud®.

6. A method of including or combining a jackpot wagering system with a casino card game according to claim 1 further comprising the step of said dealer dealing said player said portion of said complete card hand more than one time, and providing said player said further option at each interval that said portion is dealt.

7. A method of including or combining a jackpot wagering system with a casino card game according to claim 6 wherein said player must exercise said option.

8. A method of including or combining a jackpot wagering system with a casino card game according to claim 6 wherein said player is not offered said further option unless said player exercised said option.

9. A method of including or combining a jackpot wagering system with a casino card game according to claim 6 wherein said player can only win said predetermined percentage of said progressive bonus if said player exercised said option and every said further option.

10. A method of including or combining a jackpot wagering system with a casino card game according to claim 9 wherein said casino card game is Five Card Stud and said player is provided said further option three times.

11. A method of including or combining a jackpot wagering system with a casino card game according to claim 9 wherein said casino card game is Seven Card Stud and said player is provided said further option four times.

12. A method of including or combining a jackpot wagering system with a casino card game according to claim 9 wherein said casino card game is Texas Hold-Em and said player is provided said further option three times.

13. A method of including or combining a jackpot wagering system with a casino card game according to claim 9 wherein said casino card game is Blackjack and said player is provided said further option up to four times.

14. A method of including or combining a progressive jackpot wagering system in addition to a casino card game using at least one deck of playing cards comprising the steps of:

a) a player placing a casino card wager to participate only in said casino card game;

b) providing said player an option to place a progressive jackpot wager, wherein said progressive jackpot wager is a fixed monetary amount, to participate only in said progressive jackpot wagering system prior to viewing any cards;

c) dealing a portion of a complete card hand to said player, wherein said complete card hand comprising a maximum number of cards said player receives before settling said casino card game wager and ending the casino card game, providing said player a option to place a subsequent progressive jackpot wager to participate only in said progressive jackpot wagering system after viewing said portion of said complete card hand, wherein said subsequent progressive jackpot wager comprises said fixed monetary amount;

d) apportioning said fixed monetary amount of said progressive jackpot wager and said subsequent progressive jackpot wager into a progressive jackpot through a predetermined allocation in said progressive jackpot wagering system, and separately allocating said progressive jackpot from said casino card game wager;

e) dealing a remaining portion of said complete card hand, and ending said casino card game by settling said casino card game wager wherein said player either wins or loses said casino card game at the end of every casino card game; and f) if said player placed said progressive jackpot wager and/or said subsequent progressive jackpot wager and said complete card hand comprises a predetermined arrangement of cards, then said player wins a predetermined percentage of said progressive jackpot and deducting said predetermined percentage from said progressive jackpot.

15. A method of including or combining a jackpot wagering system with a casino card game according to claim 14 wherein said player can win all of said progressive jackpot only if said player placed said progressive jackpot wager and said subsequent progressive jackpot wager.

16. A method of including or combining a jackpot wagering system with a casino card game according to claim 15 wherein said player must place said progressive jackpot wager.

17. A method of including or combining a jackpot wagering system with a casino card game according to claim 15 wherein said player is not offered a option to place said subsequent progressive jackpot wager unless said player placed said progressive jackpot.

18. A method of including or combining a jackpot wagering system with a casino card game according to claim 15 wherein said casino card game is Western Stud.

19. A method of including or combining a jackpot wagering system with a casino card game according to claim 14 further comprising the step of said dealer dealing said player said portion of said complete card hand more than one time, and providing said player a further option to place said subsequent progressive jackpot wager option at each interval that said portion is dealt.

20. A method of including or combining a jackpot wagering system with a casino card game according to claim 19 wherein said player can only win all of said progressive jackpot if said player placed said progressive jackpot wager and every said subsequent progressive jackpot wager.

21. A method of including or combining a jackpot wagering system with a casino card game according to claim 20 wherein said player must place said progressive jackpot wager.

22. A method of including or combining a jackpot wagering system with a casino card game according to claim 20 wherein said player is not offered a option or, a further option, to place said subsequent progressive jackpot wager unless said player placed said progressive jackpot.

23. A method of including or combining a jackpot wagering system with a casino card game according to claim 20 wherein said casino card game is Five Card Stud and said player is offered said option to place said subsequent progressive jackpot wager three times.

24. A method of including or combining a jackpot wagering system with a casino card game according to claim 20 wherein said casino card game is Seven Card Stud and said player is offered said option to place said subsequent progressive jackpot wager four times.

25. A method of including or combining a jackpot wagering system with a casino card game according to claim 20 wherein said casino card game is Texas Hold'em and said player is offered said option to place said subsequent progressive jackpot wager three times.

26. A method of including or combining a jackpot wagering system with a casino card game according to claim 20 wherein said casino card game is Blackjack and said player is offered said option to place said subsequent progressive jackpot wager four times.

* * * * *